US011082771B2

(12) United States Patent
Sculley et al.

(10) Patent No.: US 11,082,771 B2
(45) **Date of Patent: *Aug. 3, 2021**

(54) DIRECTED AUDIO SYSTEM FOR AUDIO PRIVACY AND AUDIO STREAM CUSTOMIZATION

(71) Applicant: Steelcase Inc., Grand Rapids, MI (US)

(72) Inventors: Darrin Sculley, Byron Center, MI (US); Mark Slager, Caledonia, MI (US); Scott Wilson, Chicago, IL (US); Mark McKenna, East Grand Rapids, MI (US); Kirk Gregory Griffes, Grand Rapids, MI (US)

(73) Assignee: Steelcase, Inc., Grand Rapids, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/917,257

(22) Filed: Jun. 30, 2020

(65) Prior Publication Data

US 2020/0336830 A1 Oct. 22, 2020

Related U.S. Application Data

(63) Continuation of application No. 16/520,917, filed on Jul. 24, 2019, now Pat. No. 10,735,858, which is a (Continued)

(51) Int. Cl.
*H04S 7/00* (2006.01)
*H04R 25/00* (2006.01)
(Continued)

(52) U.S. Cl.
CPC ..... *H04R 3/12* (2013.01); *H04R 1/1016* (2013.01); *H04S 7/302* (2013.01); *G10K 11/178* (2013.01);
(Continued)

(58) Field of Classification Search
CPC ..... H04R 3/12; H04R 25/50; H04R 3/005; H04S 7/302; H04S 3/008; H04S 7/40; G08B 3/1083
(Continued)

(56) References Cited

U.S. PATENT DOCUMENTS 6,329,908 B1 * 12/2001 Frecska ..... G08B 3/1083 340/384.7
10,171,908 B1 1/2019 Sinkov et al.
(Continued)

FOREIGN PATENT DOCUMENTS

CN 204334891 3/2015

OTHER PUBLICATIONS

Internet Archive capture of https://www.indiegogo.com/projects/dot-world-s-smallest-bluetooth-headset/, capture from Sep. 7, 2015, accessed on Apr. 20, 2018.
(Continued)

*Primary Examiner* — Vivian C Chin
*Assistant Examiner* — Ubachukwu A Odunukwe
(74) *Attorney, Agent, or Firm* — Brinks Gilson & Lione

(57) ABSTRACT

A system includes an audio transducer. The audio output of the transducer may be directed at an operator. The directionality of the audio output may ensure privacy in audio delivery. Further, the directionality of the audio output may reduce the potential for other nearby individuals to be disturbed by the audio output. A directed audio system may control the content of the audio output. The content of the audio output may be configured for applications in individual operator workspaces, multiple-operator common spaces, shared-use spaces or a combination thereof. The directed audio system may customize the audio output in accord with a stored audio profile for the operator.

20 Claims, 7 Drawing Sheets

Related U.S. Application Data continuation of application No. 15/867,973, filed on Jan. 11, 2018, now Pat. No. 10,405,096.

(60) Provisional application No. 62/445,589, filed on Jan. 12, 2017.

(51) Int. Cl.

| | |
|---|---|
| ***H04R 29/00*** | (2006.01) |
| ***H04R 3/12*** | (2006.01) |
| ***H04R 1/10*** | (2006.01) |
| *G10K 11/34* | (2006.01) |
| *H04R 1/40* | (2006.01) |
| *G10K 11/178* | (2006.01) |
| *H04S 3/00* | (2006.01) |

(52) U.S. Cl.
CPC ..... *G10K 11/34* (2013.01); *H04R 1/403* (2013.01); *H04R 2203/12* (2013.01); *H04S 3/008* (2013.01)

(58) Field of Classification Search
USPC ..... 381/111, 56, 57, 58, 306
See application file for complete search history.

(56) References Cited

U.S. PATENT DOCUMENTS

| | | | | |
|---|---|---|---|---|
| 10,405,096 | B2 | 9/2019 | Sculley et al. | |
| 2005/0271220 | A1 | 12/2005 | Bathhurst et al. | |
| 2014/0270284 | A1 | 9/2014 | Luna | |
| 2015/0382124 | A1 | 12/2015 | Hall et al. | |
| 2016/0162254 | A1* | 6/2016 | Benattar | G06F 16/60 700/94 |
| 2016/0226956 | A1 | 8/2016 | Hong et al. | |
| 2016/0232775 | A1 | 8/2016 | Scheper et al. | |
| 2017/0154514 | A1 | 6/2017 | Condon | |

OTHER PUBLICATIONS

Internet Archive capture of http://www.earin.com/, capture from Dec. 19, 2016, accessed on Apr. 20, 2018.
Internet Archive capture of https://www.hereplus.me/, capture from Nov. 10, 2016, accessed on Apr. 20, 2018.
Internet Archive capture of https://hush.technology/, capture from Dec. 16, 2016, accessed on Apr. 20, 2018.
Internet Archive capture of http://nextear.net.au/, capture from Nov. 26, 2016, accessed on Apr. 20, 2018.
Internet Archive capture of http://www.bragi.com/, capture from Dec. 11, 2016, accessed on Apr. 20, 2018.
Internet Archive capture of http://nextear.net.au:80/nextear-specifications/, capture from Nov. 26, 2016, accessed on Apr. 20, 2018.
Internet Archive capture of http://www.noveto.biz/, capture from Dec. 12, 2016, accessed on Apr. 20, 2018.
Internet Archive capture of http://www.noveto.biz/technology/, capture from Oct. 13, 2016, accessed on Apr. 20, 2018.
Internet Archive capture of http://www.customizeyoursoundscape.com/, capture from Oct. 22, 2016, accessed on Apr. 20, 2018.
Internet Archive capture of http://ownphones.com/, capture from Dec. 8, 2016, accessed on Apr. 20, 2018.

* cited by examiner

DIRECTED AUDIO SYSTEM FOR AUDIO PRIVACY AND AUDIO STREAM CUSTOMIZATION

PRIORITY

This application claims priority to and is a continuation of U.S. patent application Ser. No. 16/520,917, filed 24 Jul. 2019, and titled Directed Audio System for Audio Privacy and Audio Stream Customization, which is incorporated by reference in its entirety. U.S. patent application Ser. No. 16/520,917 claims priority to and is a continuation of U.S. patent application Ser. No. 15/867,973, filed 11 Jan. 2018, now U.S. Pat. No. 10,405,096, titled Directed Audio System for Audio Privacy and Audio Stream Customization, which is incorporated by reference in its entirety. U.S. patent application Ser. No. 15/867,973 claims priority to U.S. Provisional Patent Application Ser. No. 62/445,589, filed 12 Jan. 2017, and titled Directed Audio System for Audio Privacy and Audio Stream Customization, which is also incorporated by reference in its entirety.

TECHNICAL FIELD

This disclosure relates to directional audio, audio privacy, and personalization of audio streams.

BACKGROUND

Rapid advances in communications technologies and changing workspace organization have provided workforces with flexibility in selection and use of workplace environment. As just one example, in recent years, open plan workplaces have increased in utilization and popularity. Improvements in workspace implementation and functionality will further enhance utilization and flexibility of workplace environments.

DETAILED DESCRIPTION

Figure 1:
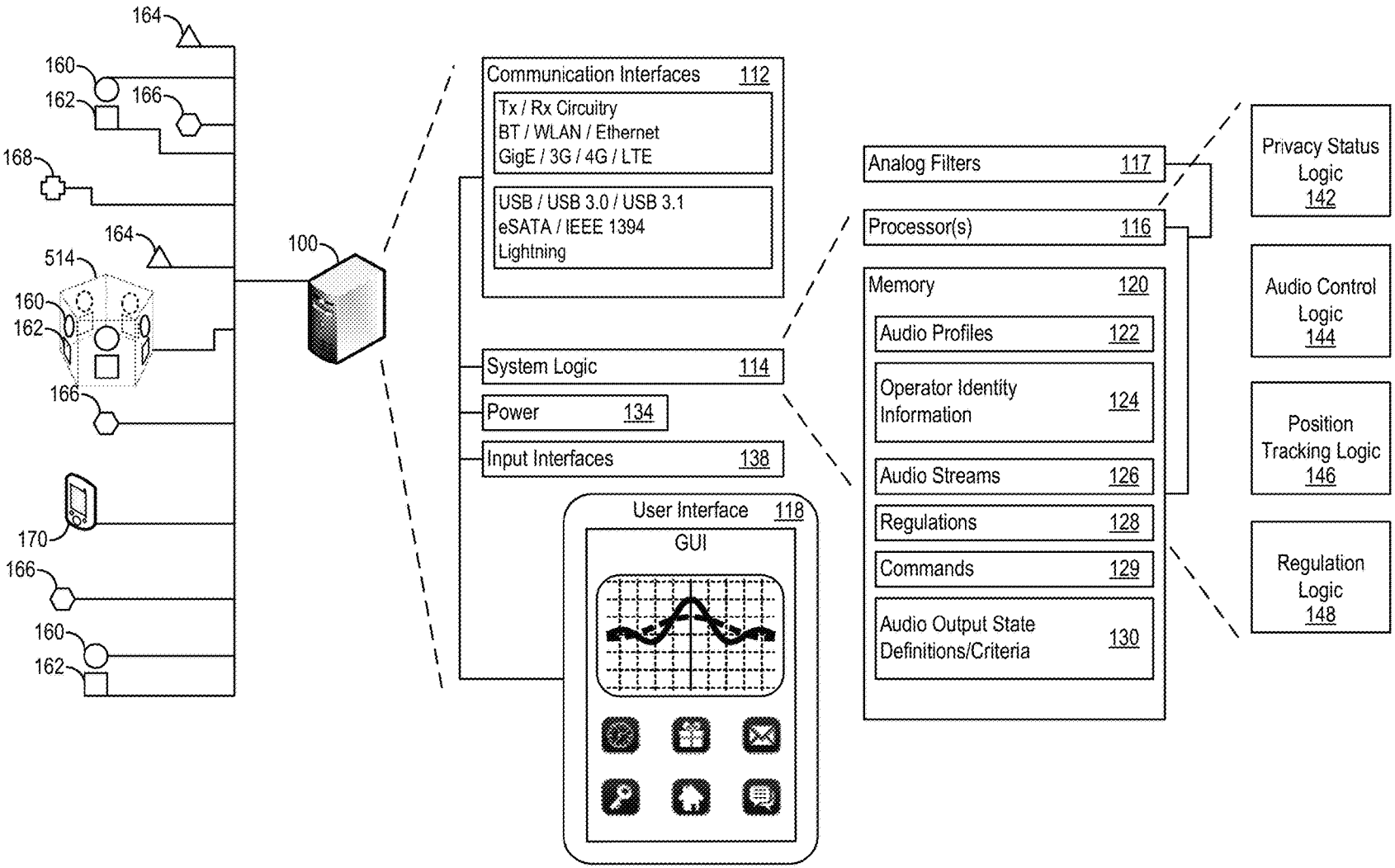
FIG. 1 shows an example directed audio system.

In various environments (such as I-spaces discussed in detail below), operators, such as, workers in a workspace, people engaging in recreation activities, people talking over the phone or in a teleconference, collaborators working in a group, or other individuals, may generate audible sounds, vibrations, or other perceptible outputs while performing their respective activities that may be distracting to others. For example, people talking in the vicinity of some listening to music may increase the volume of their own conversation to "talk over" the music. Increasing the targeting of the audio output carrying the music may decrease the "talk over" response of others nearby. Similar talking over behavior may occur in response to white noise (or other color noise) tracks being played by operators wishing to reduce audible distractions. Ironically, people attempting to talk over a white noise track may increase the level of audible distractions present in a given area. Thus, increasing the directivity of audio output may lead to quieter spaces, relative to workspaces without audio output directivity and similar audio output utilization. The reduced noise level may reduce stress among individuals within the spaces.

In some cases, the operators may use directed audio systems, such as directional loudspeakers, audio transducer arrays, earbuds, earphones, or other directed audio transducer systems to direct audio output towards themselves or other intended targets while reducing (e.g., relative to undirected audio systems) the potential of any audio output of the directed audio system to distract or otherwise disturb others. The directed audio system may be integrated with and configured for operation within a predefined workspace. For example, the directed audio system may include a transducer array mounted adjacent to a computer monitor. The transducer array may operate in an ultrasonic beamforming configuration and direct audible audio output towards the ears of the operator using position tracking sensors.

The system may also include microphones directed at the operator to capture audio from the operator. This may include audio commands for a personal assistant (human or virtual), captured audio for teleconferences, speech for dictation or translation, audio for health monitoring (such as pulse or respiration monitoring), or captured audio for other purposes. In some cases, a directed microphone, such as a beam-forming transducer array may be configured in a listening configuration.

Additionally or alternatively, the audio system may include a wireless (e.g., Bluetooth, Wi-Fi, or other wireless communication technology) transmitter that may direct an audio stream to earbuds, wireless earphones, or other wireless audio transducers for presentation to the operator. However, in some systems wired connections, such as "puck" connectors including universal serial bus (USB), USB Type-C (USB-C), 3.5 mm audio jacks or other wired interfaces, may be used to interface audio transducers to audio control circuitry (ACC) to generate audio output directed at the operator (or an operator location where the operator is detected or expected to be).

In some cases, visitors (e.g., individuals, such as coworkers, clients, intending to interact with an operator of a directed audio system) may not necessarily hear or otherwise perceive the directed audio output. Therefore, in the absence of other indicators, the visitor may not necessarily be aware that the operator is engaging with the audio output. The visitor may attempt to interact with the operator, before the operator has disengaged with the audio output. As a result, the operator may become frustrated with a premature or unexpected interruption and/or the visitor's attempts to get the attention of the operator may be ignored (either intentionally or unintentionally). In some implementations, a visual privacy status display (VPSD) may be used to indicate whether the operator is engaged with directed audio output, of which the visitor may be unaware.

The audio system may further include position tracking circuitry (PTC) which may track the position of an operator. Position and proximity information from the PTC may be used to detect the presence of an operator to begin presentation of audio output and/or shifts in the operator's position to determine when an operator intends to disengage with audio output. PTC may include ranging sensor circuitry which may determine the position of an operator and/or proximity detection circuitry which may detect the presence of an operator within a pre-determined location or within a particular range of a sensor, which may be (fully or partially)

mobile. In some implementations, position information from PTC may be used to aid in directing audio output towards an operator.

The space, e.g., a space used by an individual (I-space), in which the operator receives the directed audio output, may be separated from other spaces using physical or logical barriers. Physical barriers may include walls, panels, sight-lines, or other physical indicators demarcating the extent of the space. Logical barriers may include an effective operational extent of the audio system, such as range limits of wireless transmitters, beam forming transducer arrays, or other systems. Logical barriers may also include thresholds (such as signal quality or intensity thresholds) or relative thresholds (e.g., a directed audio system may connect to the wireless transmitter with the strongest signal).

In some implementations (such as We-spaces discussed in detail below), multiple operators may use a common space simultaneously or multiple physically separated spaces for a group purpose, such as a teleconference. In a common space, the audio system may include a multiple transducer-based audio outputs. For example, a "stalk" with multiple sides facing multiple operator locations may have transducer arrays mounted on the multiple sides. The transducer arrays may be configured to deliver directed, individualized audio outputs to operators at each of the locations. Similarly, other audio systems may use directed audio transducers, such as earbuds, earphones, passively directed loudspeakers, or other audio transducers (e.g., with wired or wireless connectivity) to provide directed, individualized audio outputs within a common space. The audio outputs may be paired with audio inputs (e.g., microphones) to capture audio for commands, monitoring, conferencing or other purposes.

In implementations using physically separated spaces for a common purpose, the spaces may operate similar to I-spaces, but audio/visual links between the spaces may be established over networks and/or serial bus links. Accordingly, the operators in the physically separated spaces may interact over the audio/visual links. In various cases, the physically separated spaces may include one or more common spaces, one or more I-spaces, or any combination thereof.

The system may include man-machine interfaces, such as user interfaces (UIs), graphical user interfaces (GUI), touch-screens, mice, keyboards, or other human-interface devices (HIDs), to allow operators to select other operators with which to form a We-space.

The PTC may include identification capabilities for determining the identity of operators to support selection of operators for a We-space. For example, the PTC may include a radio frequency identification (RFID) or near field communication (NFC) transceiver capable of reading transceiver equipped identification cards held by operators. Additionally or alternatively, the PTC may include biometric identification circuitry, such as fingerprint scanners, retina scanners, voice signature recognition, cameras coupled to facial recognition systems, or other biometric identification systems. However, in some cases, physical spaces making up a We-space may be (at least in part) selected or pre-defined based on the identity or location of the spaces. In other words, a physical space itself may be grouped into a We-space based on its own characteristics regardless of the identities of the operators within that physical space. For example, two conference rooms within two different office sites of a corporation could be merged into a We-space that persists regardless of who enters or leaves the two conferences rooms (e.g., the rooms themselves are selected to make-up the We-Space rather than the occupants of the rooms). Other criteria may be used in selecting operators, physical locations, or any combination thereof to make-up a We-Space.

Additionally or alternatively, We-spaces may be implemented to assist in regulating the behavior of individuals in areas shared by multiple other spaces (e.g., I-spaces, or multiple-operator spaces). For example, a We-space may include a shared hallway nearby multiple individual workspaces. A directed audio system within the hallway may be used to direct instructions to individuals walking through the hallway. In the example, the instructions may be issued by regulation circuitry to remind the individuals walking through to be quiet so as not to disturb others in the nearby spaces. The regulation circuitry of the directed audio system may be equipped with microphones. In some cases, the microphones or PTC may be used to detect operators engaging in an infraction of the regulations (e.g., noise level thresholds, speed thresholds, cell-phone use regulations, or other regulations). Where infractions are detected, the directed audio system may direct instructions at violators and reduce or eliminate instructions directed at individuals in compliance with regulations. In some cases, the use of directed audio may prevent the individual receiving the instructions from having the social embarrassment associated with being publically reprimanded because the directed audio may not necessarily be perceptible by others.

In some implementations, the directed audio system may be used to deliver customized audio streams to operators based on operator identity and individualized audio profiles. The directed audio system may access stored audio profiles from various operators using the system. The stored audio profiles may include parameters for audio output or input for particular operators.

For example, the parameters may include equalization parameters for various outputs. The equalization parameters may include particular equalization parameters for different operations. An operator may have one or more equalization patterns for music output. The same operator may have a separate equalization pattern for speech to facilitate comprehensibility. In some cases, equalization patterns may account for hearing loss or other handicaps. The audio parameters may also include volume levels, which may be fine-tuned by the directed audio system using the position of the operator relative to the transducer producing the output (e.g., to maintain a constant volume level regardless of relative position).

The audio profiles may include filtering (or digital audio manipulation) parameters. Accordingly, audio may be frequency shifted or otherwise filtered instead of, or in addition to, being equalized by the directed audio system. For example, audio may be filtered to remove specified sounds. The audio profile may call for removal of infrasound or other low frequency audio present in the ambient environment.

The audio profiles may include details of custom inputs to place into the audio output. For example, the audio profile may include a noise color preference (e.g., a preference for pink noise over white noise or other noise preference). The audio profile may also include a request for personalized calendar reminders or particular preferences for "coaching" type audio. Coaching type audio may include relaxation advice, break reminders, self-esteem boosters, or other coaching.

Additionally or alternatively, the audio profile may include parameters for privacy state preferences, conditions for visitor interruptions, or other personalized preferences for operation of the directed audio system.

As discussed above, the directed audio system may track an operator's engagement with audio output and execute interruptions when the operator disengages, receives a visitor, or otherwise indicates a privacy state change. Accordingly, the techniques and architectures discusses herein improve the operation of the underlying hardware by proving a technical solution resulting in increased responsiveness of the system to operator interaction. In addition, the directedness of the audio output is a technical solution that increases operator privacy while reducing potential distractions to others nearby the operator. In multiple-operator scenarios, the directed audio system provides a technical improvement that allows the underlying hardware to provide customized audio output streams in common spaces and merge physically separate spaces for use in a group operation. Further, the stored customized audio profile provides a technical solution that allows the underlying hardware to have an operator-specific operational profile without necessarily requiring the operator to repeatedly re-enter specific preferences. Accordingly, the techniques and architectures discussed herein comprise technical solutions that constitute improvements, such as improvements in user experience due to increased system responsiveness and personalization, to existing market technologies.

Referring now to FIG. 1, an example directed audio system (DAS) 100 is shown. The DAS 100 may be used to provide operators with customized audio output (e.g., customized according to a stored audio profile 124) in one or more I-spaces, one or more We-spaces, or any combination thereof. The example DAS 100 may include system logic 114 to support operations on audio/visual inputs and outputs. For example, the system logic may support digital manipulation of audio streams, analog filtering, multichannel mixing, or other operations. The system logic 114 may include processors 116, analog filters 117, memory 120, and/or other circuitry, which may be used to implement the privacy status logic 142, audio control logic 144, position tracking logic 146, and regulation logic 148. Accordingly, the system logic 114 of the DAS 100 may operate as privacy status circuitry, audio control circuitry, position tracking circuitry, regulation circuitry or any combination thereof. The memory 120, may be used to store audio profiles 122, operator identity information 124 (e.g., biometric data, RFID profiles, or other identity information), audio streams 126, regulations 128, commands 129, audio output state definitions/criteria 130, or other operational data for the DAS 100. The memory may further include applications and structures, for example, coded objects, templates, or other data structures to support audio manipulation operations, audio stream transport, or other operations.

The DAS 100 may also include communication interfaces 112, which may support wireless (e.g. Bluetooth, Wi-Fi, WLAN, cellular (4G, 4G, LTE/A)), and/or wired (ethernet, Gigabit ethernet, optical) networking protocols. The communication interfaces 112 may further support serial communications such as IEEE 1394, eSATA, lightning, USB, USB 3.0, USB 3.1 (e.g., over USB-C form factor ports), or other serial communication protocols. In some cases, the system logic 114 of the DAS 100 may support audio channel mixing over various audio channels available on the communication protocols. For example, USB 3.1 may support up to 20 or more independent audio channels, the DAS 100 may support audio mixing operations over these channels. In some implementations, the DAS 100 may support audio mixing or other manipulation with Bluetooth Audio compliant streams.

The DAS 100 may include various input interfaces 138 including man-machine interfaces and HIDs as discussed above. The DAS 100 may also include a user interface 118 that may include human interface devices and/or graphical user interfaces (GUI). The GUI may render tools for selecting specific operators or spaces to be joined in particular operations, commands for adjusting operator audio profile preferences, or other operations.

The DAS 100 may include power management circuitry 134 which may supply power to the various portions of the DAS 100. The power management circuitry 134 may support power provision or intake over the communication interface 112. For example, the power management circuitry 134 may support two-directional power provision/intake over USB 3.0/3.1, power over ethernet, power provision/intake over lightning interfaces, or other power transfer over communication protocols.

The DAS 100 may be coupled to one or more audio transducers 160 (e.g., disposed within I-spaces or We-spaces). The audio transducers 160 may include loudspeakers, earbuds, ear phones, piezos, transducer arrays (such as ultrasonic beamforming transducer arrays), or other transducer-based audio output systems. The audio transducers may be coupled (e.g., wired or wirelessly) to the DAS 100 through communication interfaces 112 or via analog connections, such as 3.5 mm audio jacks. In various multiple-operator location spaces, audio transducers may be mounted on example stalk transducer mount 514 (shown from a perspective view). A stalk transducer mount may be multi-faceted. The example stalk transducer mount 514 has five faces to support five audio transducer 160/audio input source 162 pairs.

In various implementations, beamforming transducer arrays may include multiple transducers capable of forming one or more beams (e.g., using ultrasonic sound wave output). The individual transducers in the array may be spatially separated (e.g., in a grid formation) may output ultrasonic sound waves at different phases to generate constructive/destructive interference patterns. The inference patterns may be used to form directed beams. Further, the outputs from the individual transducers in the array may be frequency detuned to render audible soundwaves within the human-perceptible audio spectrum.

In some configurations with passive audio directivity, the audio transducer 160 may be disposed with a chassis that facilitates passive direction of sound waves. For example, the audio transducer may be placed with a parabolic dish or horn-shaped chassis. Further, active audio directivity may be combined with passive elements. For example, a parabolic chassis equipped audio transducer may be mounted on a mechanical rotation stage or translation stage to allow for directivity adjustments as an operator shifts position.

The DAS 100 may also be coupled to one or more audio input sources 162 (such as microphones or analog lines-in). Microphones may include mono-channel microphones, stereo microphones, directional microphones, or multi-channel microphone arrays. In some cases, microphones may also include transducer arrays in listening configurations. For example, a listing configuration may include recording inputs at individual transducers of the array at periodic intervals, where the period intervals for the individual transducers are phase shifted with respect to one another so as to create a virtual "listening" beam. Virtual beam formation for listening configurations may be analogous to beamforming operations for audio output. However instead of generating output at various phases or harmonics to create output beam, listening configuration may accept input at the same phases or harmonics to create a virtual "listening" beam. Accordingly, a transducer array may act a directional microphone.

The DAS 100 may apply echo cancelling algorithms (e.g. digital filtering, analog feedback cancellation, or other echo cancellation schemes) to remove audio output from audio transducer 160 captured at audio input source 162.

The DAS 100 may be coupled to ranging sensor circuitry 164 and/or proximity sensor circuitry 166, and/or biometric identification circuitry 168. The ranging sensor circuitry 164 may include multiple camera systems, sonar, radar, lidar, or other technologies for performing position tracking (in up to three or more dimensions) in conjunction with the position tracking logic 146 of the DAS 100. The ranging sensor circuitry 164 may track posture, movement, proximity, or position of operators. For example, the ranging sensor circuitry 164 may track whether an operator is in a sitting position, recline position, or standing position. The ranging sensor circuitry 164 may also track position and proximity for various parts of an individual. For example, the ranging sensor circuitry 164 may also track head position or orientation, ear position, hand motions, gesture commands, or other position tracking. The position tracking logic 146 may generate position information based on the tracking data capture by the ranging sensor circuitry 164.

The data captured by ranging sensor 164 may be redacted or quality degraded prior to recordation to address privacy concerns. For example, images captured by motion tracking cameras may be stripped of human-cognizable video by recording tracking point positions and stripping other image data.

The proximity sensor circuitry 166 may detect operator presence (e.g., by detection of a RFID or NFC transceiver held by the operator) in conjunction with the position tracking logic 146. The proximity sensor circuitry may also include laser tripwires, pressure plates or other sensors for detecting the presence of an operator within a defined location. The proximity sensor circuitry 166 may also perform identification operations using wireless signatures (e.g., RFID or NFC profiles).

The privacy status logic 142 may determine the timing for starting or interrupting audio output based on the presence or position information generated by the position tracking logic 146 responsive to the data collected by the ranging sensor circuitry 164 and the proximity sensor circuitry 166.

The biometric identification circuitry 168 may include sensors to support biometric identification of operators (or other individuals such as visitors). For example the biometric identification circuitry 168, in conjunction with the position tracking logic 146, may support biometric identification using fingerprints, retinal patterns, vocal signatures, facial features, or other biometric identification signatures.

In various implementations, the DAS 100 may be coupled to one or more VPSDs 170 which may indicate engagement of the operator with audio output and/or operator receptiveness to visitors/interruptions. For example, the VPSD 170 may switch between audio output states indicating a privacy state or an interaction state. The privacy state may indicate that the operator is engaged with audio output and may not necessarily notice approaching visitors without an alert issued through the DAS 100. The interaction state may indicate that an operator has or is disengaged with the audio output and is ready for interactions or other alternative engagement. The VPSD 170 support additional audio output states, such as do not disturb (DND) states through which operators may indicate a preference for no interruptions or visitors. As discussed below, the VPSD may include a multicolor array of lights (e.g., light emitting diode (LED) lights) indicating the various audio output states. Additionally or alternatively, the VPSD may include lights in toggle states which may switch on or off to indicate audio output states. Further, the VPSD may include a monitor display capable of indicating the current privacy state by rendering different pixel configurations on the monitor. For example, the monitor may display the phrase "privacy state", a symbol, or other visual signature to indicate the privacy state. Further, the monitor-based VPSDs may indicate a schedule of privacy and interaction states for an operator (e.g., based on entries from the operator's calendar application).

VPSDs may include multiple display implementations. For example, a VPSD may include a display at the entryway to a workspace, e.g., to provide guidance to visitors outside and workspace, paired with another display inside the workspace, e.g., to provide guidance once a visitor has entered the workspace.

In various implementations, the DAS 100, including the system logic 114 and memory 120, may be distributed over multiple physical servers and/or be implemented as a virtual machine.

I-Spaces

Figure 2:
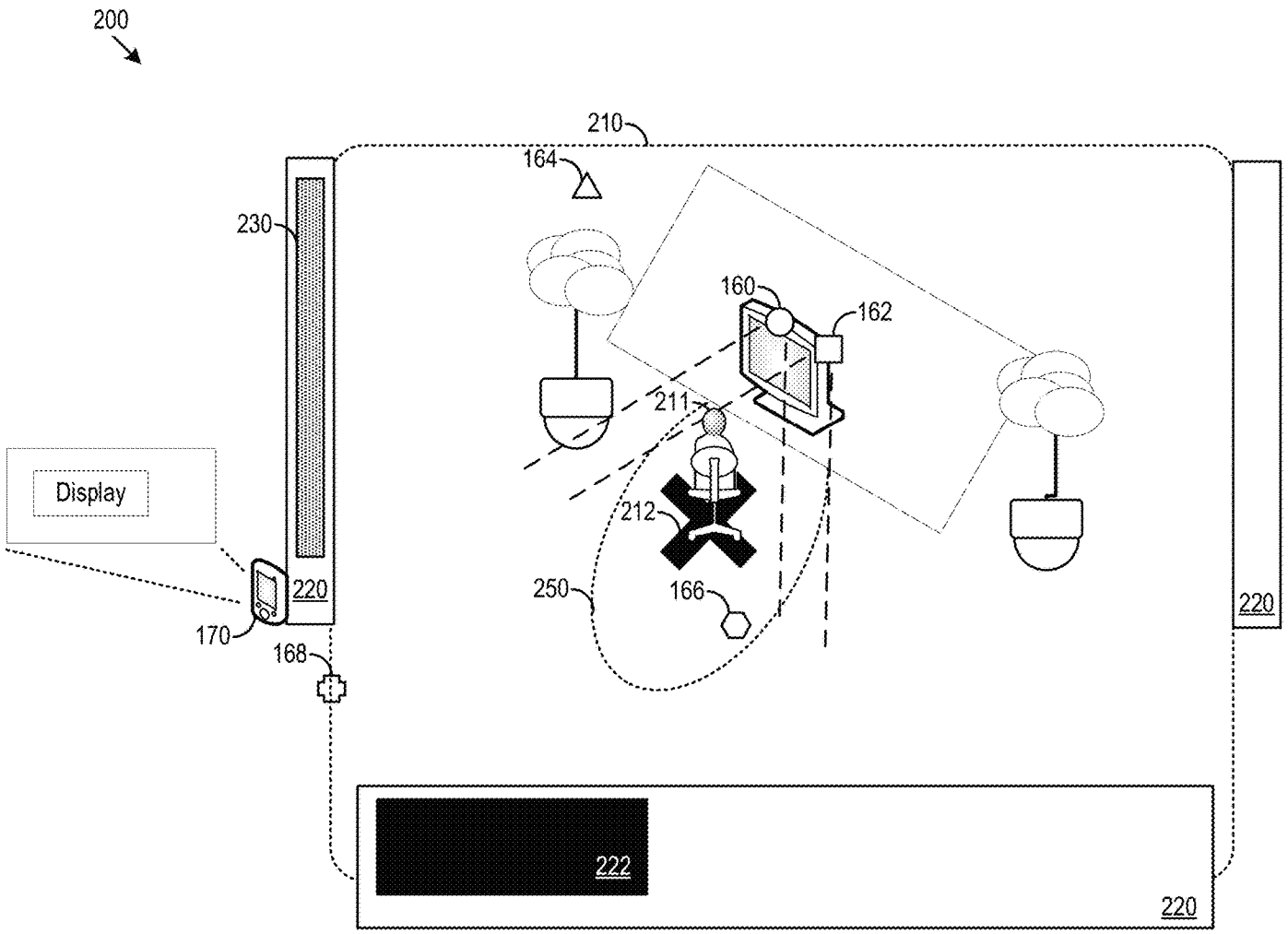
FIG. 2 shows an example I-space.

In various implementations, the DAS 100 may be used to support audio output presentation in I-spaces, such as single operator environments. Referring now to FIG. 2, an example I-space 200 is shown. The example I-space 200 may include or be coupled to a DAS 100. The I-space may include a workspace 210 or other space in which an operator 211 may perform tasks and engage with the audio/visual output of the DAS 100. The workspace 210 may be delimited by barriers 220 which may be physical or virtual. The workspace 210 may include computers, tools, work desks, seating, or other furniture to support completion of individual tasks, assignments, or activities, such as viewing media, drafting documents, making calls, responding to communications, manufacturing, or other tasks, assignments, or activities.

Within the workspace 210, the I-space 200 may include one or more audio transducers 160 configured to direct audio output at an operator location 212. The operator location 212 may be an area in which an operator is detected, exists, or is expected to exist. In some cases, operator locations 212 may be predefined. For example, an operator 211 may be expected to sit on chair within the workspace 210. Additionally or alternatively, the operator location 212 may be more specifically defined or completely defined by the current position of the operator (e.g., as determined by position tracking logic 146).

Direction of the audio output to the operator location may occur passively or via active tracking by the position tracking logic 146. For example, earbuds may direct audio at an operator location because the earbuds operate while affixed to the operator's ears. A beamforming transducer array may use position information to detect and track the position of the operator. Using the position information, the beamforming transducer array may direct an audio beam toward the ears of the operator within the operator location 212. Similarly, audio input sources 162 may be directed to the operator location 212.

The I-space may further include a VPSD 170 to indicate the current privacy state of the operator.

In some implementations, the I-space may include ranging sensor circuitry 164, proximity sensor circuitry 166, or biometric identification circuitry 168 to support detection, tracking, and/or identification of individuals within the workspace 210.

Additionally or alternatively, the barriers 220 may further supplement audio or other sensory privacy for the workspace 210. For example, the barriers 220 (e.g., physical barriers) may include windows 222. The windows 222 may allow operators or other individuals to peer into or out of the workspace 210. In some cases, the windows 222 may include different optical density states. For example, the optical density states may include a visibility state where the window is transparent and an opaque state where the window is opaque or otherwise obstructed. In an example system, mechanical shades may be lowered (e.g., automatically) to change the windows 222 to an opaque state or lifted to change the windows to a visibility state. In some implementations, the transparency of the window 222 itself may be altered. For example, the window may be made of a glass (or polymer) that darkens when exposed to electrical current (e.g., electrochromic materials).

Similarly, pairs of transparent plates coated with linearly polarized material may be rotated relative to one another to generate varying levels of opacity to generate a window with different transparency states. In some cases, round plates may be used for the pairs. An operator may not necessarily notice the rotation of a round object because of the circular symmetry of the round object. Accordingly, the dual plate window may darken without apparent motion since the rotation of the one (or both) of the round plates may be nearly imperceptible. Although plates having non-circular shapes do not exhibit circular symmetry, windows of virtual shape may be constructed using this principle. An aperture with a cross-section of any shape may be used to cover the round plates. Accordingly, rectangular, square, ovular, multi-aperture, or other window shapes may be circumscribed onto the round plates providing the varying opacity effect.

In various implementations, the operation of the window 222 optical density states may be controlled by the privacy status logic 142 of the DAS 100. Accordingly, the privacy status logic 142 may control delivery and timing of audio outputs by determining operator engagement levels while also changing audio output states for other senses in parallel. For example, the privacy status logic 142 may darken the windows 222 when an operator engages with audio output from the audio transducer 160 and lighten the windows 222 when the operator disengages.

The barriers 220 may also include passive or active sound damping systems 230. Active sound damping systems may be activated/deactivated by the privacy status logic 142.

In some cases, reducing sensor inputs from sources outside the workspace 210 may increase operator focus and productivity when performing activities within the workspace 210. For example, reducing visual distractions may free "intellectual bandwidth" of the operator for focus on a specific task within the workspace 210.

Passive sound damping materials may include waffle structures, foams, or other solid sound insulation. Additionally or alternatively, passive sound damping systems may include liquid or viscous substances stored within containment structures within the barriers. Various thixotropic materials may exhibit sound dampening characteristics similar to some solid materials but, in some cases, in a more compact space. Solid materials may be used in cases where flexibility in containment structures may be advantageous or space is plentiful. Liquid or viscous sound damping may be used in implementations where space is capped or available at a high premium relative to costs associated with sound damping installation. In some cases (e.g., where ultrasonic transducers are used), barriers may be constructed using materials that absorb ultrasonic soundwaves. Ultrasonic absorption may assist the DAS 100 in maintaining audio privacy and prevent surreptitious snooping of audio output.

In various implementations, the audio transducers 160 and audio inputs 162 present within the I-space 200 may be mounted on various objects within the workspace 210. For example, as shown in the example I-space the audio transducer 160 and audio input 162 are mounted on a monitor chassis. Similarly, proximity sensor circuitry 166, ranging sensor circuitry 164, and/or biometric identification circuitry may be mounted on structures throughout example I-space 200. The position tracking logic 146 may also adjust object positioning (e.g., monitor positioning) and audio transducer/input positioning to adjust to operator posture shifts.

The workspace 210 may include cues 250, such as signs, sightlines, markings, or structures to aid operators in engaging with the directed audio output from the DAS 100. For example, the floor within the workspace 210 may include a marking 250 showing acceptable chair positions for interacting with the audio transducer 160. The marking 250 may trace the extent of the operation range of the audio transducer 160. Accordingly, the marking may aid the operator in staying within range of the audio transducer by providing a visual guide. Barriers 220 may also be used as cues 250 to provide operational guidance to operators.

Figure 3:
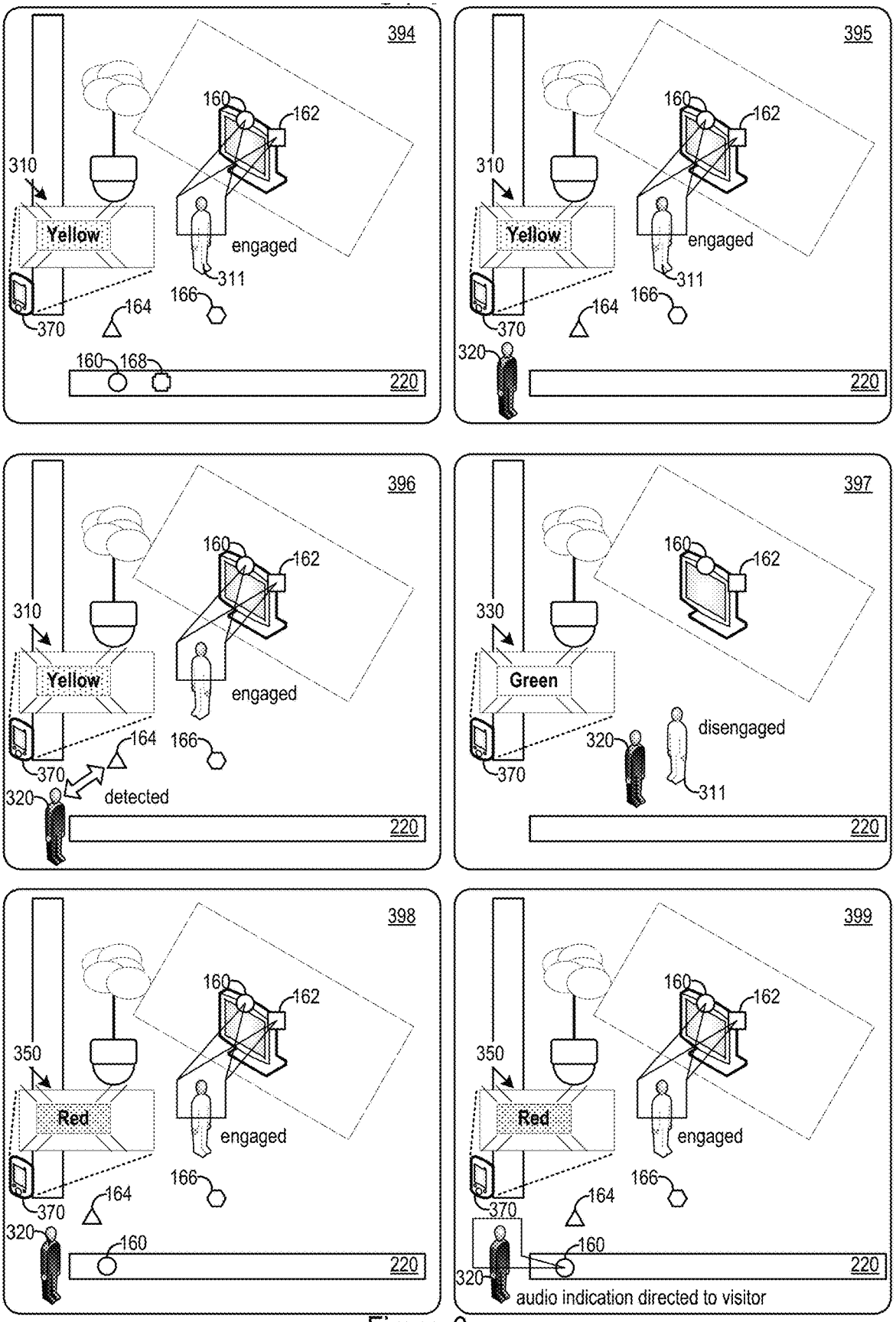
FIG. 3 shows example audio output states for an example visual privacy status display.

FIG. 3 shows example audio output states 310, 330, 350 for an example VPSD 370. The example VPSD 370 may be disposed within or nearby a workspace 210. The VPSD 370 may indicate the current state for an operator 311 interacting with a DAS 100. The example VPSD 370 includes a multicolor LED display. However, other VPSD designs, such as monitor-based designs, other LED color schemes for state identification, monochrome LEDs, or other display designs, may be used with the DAS 100.

The example VPSD 370 may use a yellow LED to indicate a "privacy" state 310 in which the operator 311 is engaged with an audio output from the DAS 100 (394). As visitor 320 may approach the workspace (e.g., workspace 210) while the operator is engaged with the audio output (395). The position tracking logic 146 or DAS 100 may detect the visitor 320 (396). For example, the position tracking logic 146 may detect the visitor 320 using circuitry 162, 164, 166 and/or the DAS 100 may capture audio (via an audio input 162) of the visitor 320 attempting to gain the operator's 311 attention. The DAS 100 may contain an audio profile preference in which the DAS 100 may interrupt the audio preference when the DAS 100 captures audio include a spoken instance of the operator's name or other specified audio sequence. Once, the visitor 320 is detected, the privacy status logic 142 of the DAS 100 may interrupt the audio output and the operator 311 may disengage. Accordingly, the VPSD may change into an interaction state 330 by displaying a green LED (397). Additionally or alternatively, the DAS 100 may send an alert to the operator and give the operator an opportunity to decline to interrupt the audio output to talk with the visitor. For example, the DAS 100 may cause a GUI under control of the operator to present the operator with a selection pre-defined response routines for the visitor (e.g., a message to the visitor to come back after a specified period, an offer to schedule/reschedule a meeting, or other response routine).

In another example scenario, the operator may be engaged with audio output and the VPSD 370 may use a red LED to indicate a DND state 350 (398). When a visitor 320 is detected, the red LED may indicate that the operator is not accepting interruptions. Additionally or alternatively, the DAS 100 may use an audio transducer 160 to send a directed audio indication to the visitor 320 to come by another time or that the DAS 100 will inform the operator that the visitor 320 came by once the operator has ended the DND state 350 (399). In some implementations where the operator is provided with alerts while in the privacy state 310, the alerts may be forgone while the system is in the DND state 350.

The visual indicators of the VPSD provide a hardware-based technical solution to challenges with social isolation resulting from audio interaction. Specifically, the VPSD may provide an express indication of availability. This may reduce confusion arising from visitors assuming unavailability or availability when an operator is engaged with audio output. Further, in implementation where visual cues that an operator is engaged with audio output may be subtle or non-existent (e.g., transducer array beamforming implementations where the operator does not wear earphones), the VPSD provides a clear indication of the operator's engagement. This may reduce the chance of visitors having the impression that their attempts interact with the operator where ignored. Accordingly, operators are able use the VPSD to present an indication of social unavailability/availability independently of their engagement with audio output.

Figure 4:
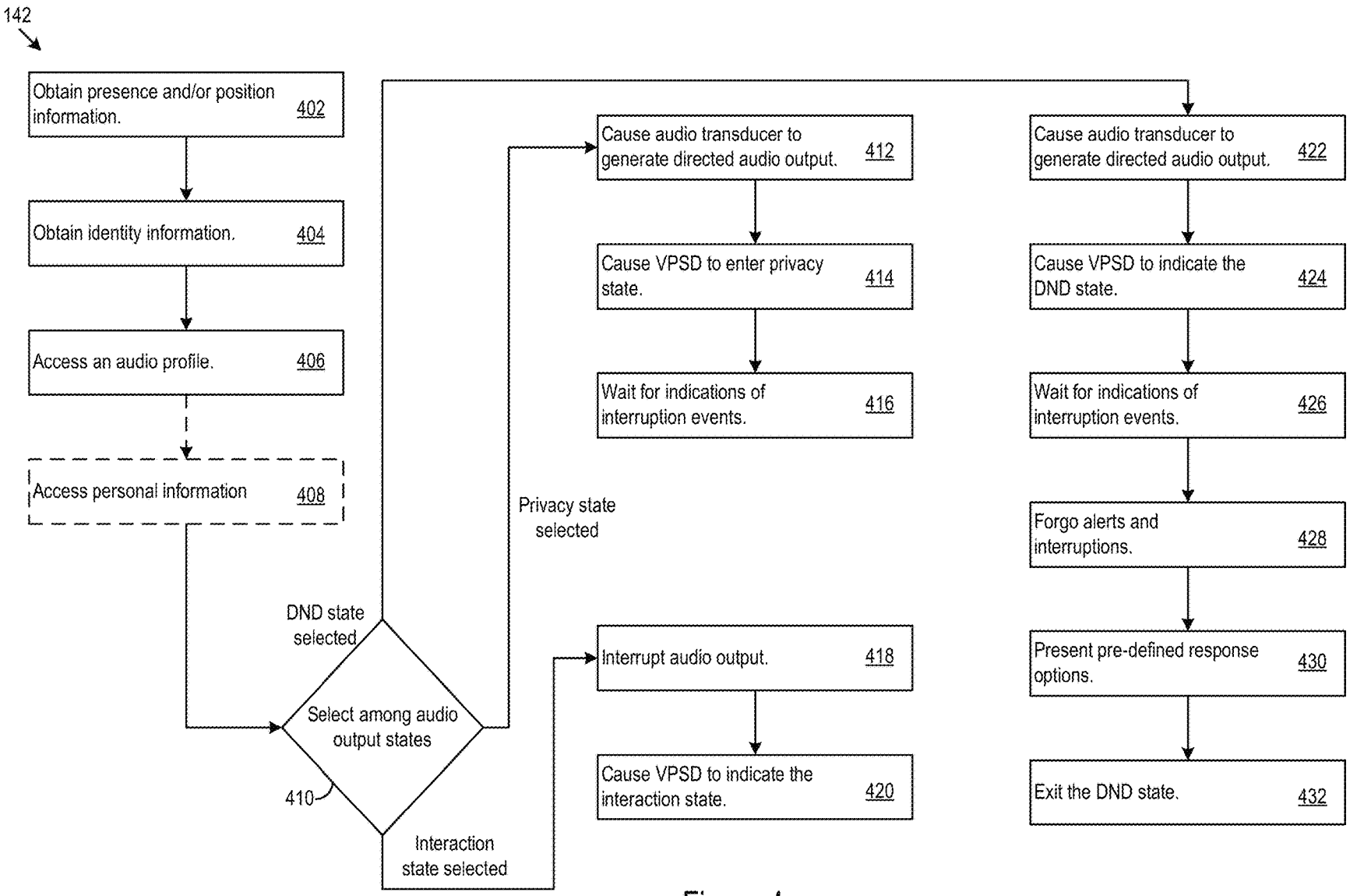
FIG. 4 shows example privacy status logic.

Moving now to FIG. 4, example privacy status logic 142 is shown. The privacy status logic 142 may obtain presence and/or position information from the position tracking logic 146 (402). For example, the privacy status logic 142 may access a stored log of presence and/or position information from the position tracking logic 146. Additionally or alternatively, the position tracking logic 146 may send the presence and/or position information to the privacy status logic 142. The privacy status logic may obtain identity information for an operator (404). For example, the privacy status logic 142 may query the position tracking logic 146 for an operator identity based on identity information captured from the proximity sensor circuitry 166 or the biometric identification circuitry 168. In some cases, the position tracking logic 146 may push the identification information to the privacy status logic 142 and/or the audio control logic 144, as discussed below.

The privacy status logic 142 may access an audio profile for the operator based on the identification information (406). Within the audio profile, the privacy status logic may determine conditions for switching between privacy states, interaction states, or other configured audio output states. Additionally or alternatively, the privacy status logic 142 may access personal information (such as, calendar application data to support VPSD displays, food ordering histories, browsing histories, purchase histories, command histories or other personal information) for the operator (408).

Responsive to the presence and/or position information and audio output state criteria in the audio profile, the privacy status logic 142 may select among audio output states (410). When the privacy state is selected, the privacy status logic 142 may cause an audio transducer (e.g., audio transducer 160) to generate a directed audio output at an operator location (412). The privacy status logic 142 may cause a VPSD to indicate the privacy state (414). The privacy status logic may wait for indications of interruption events from the position tracking logic 146 (416). For example, the privacy status logic 142 may wait for indications of visitor arrivals or operator position changes.

When the interaction state is selected, the privacy status logic 142 may interrupt audio output (418). For example, the privacy status logic 142 may stop or pause audio output being presented by the audio transducer. The privacy status logic 142 may further cause the VPSD to indicate the interaction state (420) to indicate that the operator has disengaged with the audio output.

When the DND state is selected, the privacy status logic 142 may cause an audio transducer (e.g., audio transducer 160) to generate a directed audio output at an operator location (422). The privacy status logic 142 may cause a VPSD to indicate the DND state (424). The privacy status logic 142 may wait for indications of interruption events from the position tracking logic 146 (426). The privacy status logic 142 may forgo alerts and interruptions when detected in the DND state (428). The privacy status logic 142 may present pre-defined response options to visitors arriving during the DND period (430). The privacy status logic 142 may exit the DND state when end conditions are met (432). For example, the DND state may be terminated when the operator disengages with the audio output. Additionally or alternatively, the DND state may be terminated upon express command from the operator or a scheduled end within a calendar application.

The privacy status logic 142 may be configured to handle other external interruptions. For example, in privacy and/or DND states, the privacy status logic 142 may also change phone settings. In the example, the privacy status logic may send calls straight to voicemail in a DND state. Additionally or alternatively, the privacy status logic 142 may generate a virtual "ringer" within audio output during the privacy state to alert the operator to a ringing phone while the operator is engaged with the audio output. The privacy status logic 142 may also convert text messages to speech for presentation to the operator while engaged with the audio output.

We-Spaces

Figure 5:
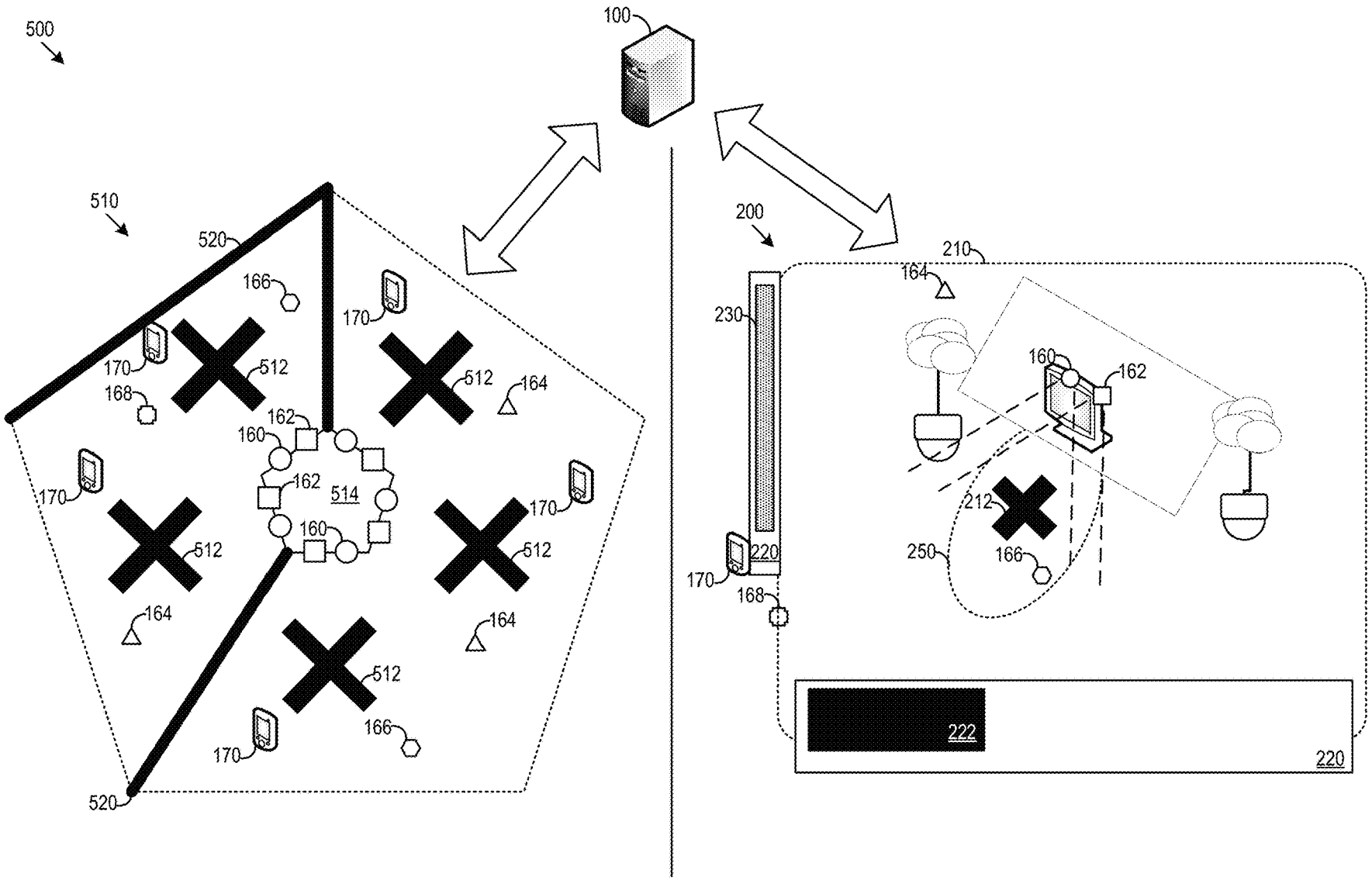
FIG. 5 shows an example We-space.

We-spaces, as discussed above, may include multiple-operator location common areas, shared common areas (such as hallways or lobbies) for multiple other spaces, collaboration areas, convention centers, combinations of I-spaces and/or multiple-operator location spaces, or other spaces. FIG. 5 shows an example We-space 500 which includes an example multiple-operator location space 510 combined with example I-space 200. The multiple-operator location space 510 includes five example operator locations 512.

The five example operator locations 512 are serviced by an example stalk transducer mount 514 (shown from above). The stalk transducer mount 514 may have an audio transducer 160 on each of its faces to direct audio output to each of the multiple example operator locations 512. The stalk transducer mount 514 may support audio inputs 162 to capture audio from operators at each of the operator locations 512. The multiple-operator location space 510 may be coupled to the DAS 100 and to example I-space 200 via the DAS 100. The DAS 100 may exchange among themselves audio streams based on the captured audio from the various operator locations 512 in the multiple-operator location space 510 and the operator location 212 in the I-space 200. The operator locations 512 and 212 may include UIs (e.g., on individual operator consoles) capable of rendering tools to instruct the DAS 100 to select operators or operator locations to include within the We-space 500 and/or subgroups thereof.

The operator locations 512 may be delimited by (physical or logical) barriers 520 similar to those discussed above with respect to I-space 200 above.

Further, the operator locations may include circuitry 164, 166, 168 for determining operator position, presence, or identity as discussed above.

In some implementations, the stalk transducer mount 514 may host one or more beamforming ultrasonic transducer arrays for audio output or directed virtual beam listening. The ultrasonic transducer arrays may be substituted for fewer arrays capable of MIMO beam formation. For example, the five example operator locations could be covered by three ultrasonic transducer arrays capable of 2×2 MIMO beam/listening beam formation.

Although the multiple operator locations 512 in example multiple-operator location space 510 are serviced by a stalk transducer mount, other transducer mounting schemes are possible of other multiple-operator location spaces. For example, earphones or earbud-style audio output system may be used. Microphones and/or audio loudspeakers may be mounted on operator seating, embedded within furniture, on terminals or smartphones in possession of the operators, or disposed at other positions. Virtually any configuration where audio output may be directed in an operator location specific manner may be implemented.

When audio is exchanged among the operator locations, similar to a teleconference, the DAS 100 may perform audio manipulations on the audio captured from the various operators. For example, the captured conference audio may be normalized—louder participants may have their voices attenuated while quieter participants may be amplified. Audio may be filtered and otherwise digitally altered to improve comprehensibility of participants. For example, low register hums or breathing may be removed. However, in some cases, low register audio may be maintained to protect the emotional fullness of vocalizations (e.g., where participants do not indicate concerns with comprehensibility or in high-fidelity implementations).

Additionally or alternatively, the DAS 100 may provide (e.g., on GUI consoles), feedback regarding voice levels. For example, when an operator is speaking too loudly the DAS 100 may indicate high (e.g., redlining) recording levels to the operator. This may cause the operator to reduce his or her speaking volume. Similarly, when an operator is too quiet, the DAS 100 may indicate a low signal-to-noise ratio for the recording. This may encourage the operator to increase his or her volume. Providing feedback, such as visual feedback, may help to reduce spirals where participants continually raise or lower their voices in to match the levels heard in the audio output. This may also assist hearing-impaired individuals regulate voice levels.

The DAS 100 may also use position information allow virtual conferences setup through We-spaces mimic in-person settings. For example, the DAS 100 may detect when operator is facing another operator. The DAS 100 may respond to this positioning information by increasing the voice volume perceived by the operator that is being faced. Gesture detection may also be used to augment audio presentation. For example, when an operator points to another operator, perceived voice volume by the pointee may be (temporarily) increased.

We-spaces may be implemented in open noisy scenarios. For example, in restaurants, schools, nursing homes, or trade shows often multiple-parallel conversations are carried out. Often the parallel conversations are contentious for volume resources. That is, the participants in the parallel conversations attempt to talk over the noise created by other parallel conversations. The DAS 100 may generate virtual bubbles around the participants in the various conversations, such that audio captured from one participant is only forwarded to other participants in the same conversation. The participants may indicate membership in a particular conversation through gestures (e.g., pointing at other participants), positioning (clustering near other participants or facing other participants), express command (indicating conversation participation on a console), or other indications.

As discussed above, We-space implementations may be used for regulation of individuals in shared common spaces. For example, the regulation logic 148 of the DAS 100 may be used to remind individuals traversing a shared hallway to maintain courteous voice volume levels using audio transducers and microphones.

Additionally or alternatively, the regulation logic 148 may assist operators (e.g., in navigating unfamiliar areas or finding meeting locations). For example, the regulation logic 148 may indicate to a passerby that they should make a turn at the next hallway to arrive at an indicated destination. The regulation logic 148 may also direct audio instructions to a late arriving meeting participant. For example, the regulation logic may direct an audio instruction indicating that the participant has arrived at the correct location (or alternatively has arrived at an incorrect location). In some cases, the regulation logic may allow the participant to hear the content of the meeting (as if listening through the conference room door) to aid in confirming that the right destination was reached. This may reduce the chance that a participant walks into an incorrect meeting.

The regulation logic 148 may also provide audio signage. For example, an operator walking through a hallway may request (e.g., through a microphone) instructions to nearby facilities (e.g., copy rooms, restrooms, recreation areas, or other facilities).

Figure 6:
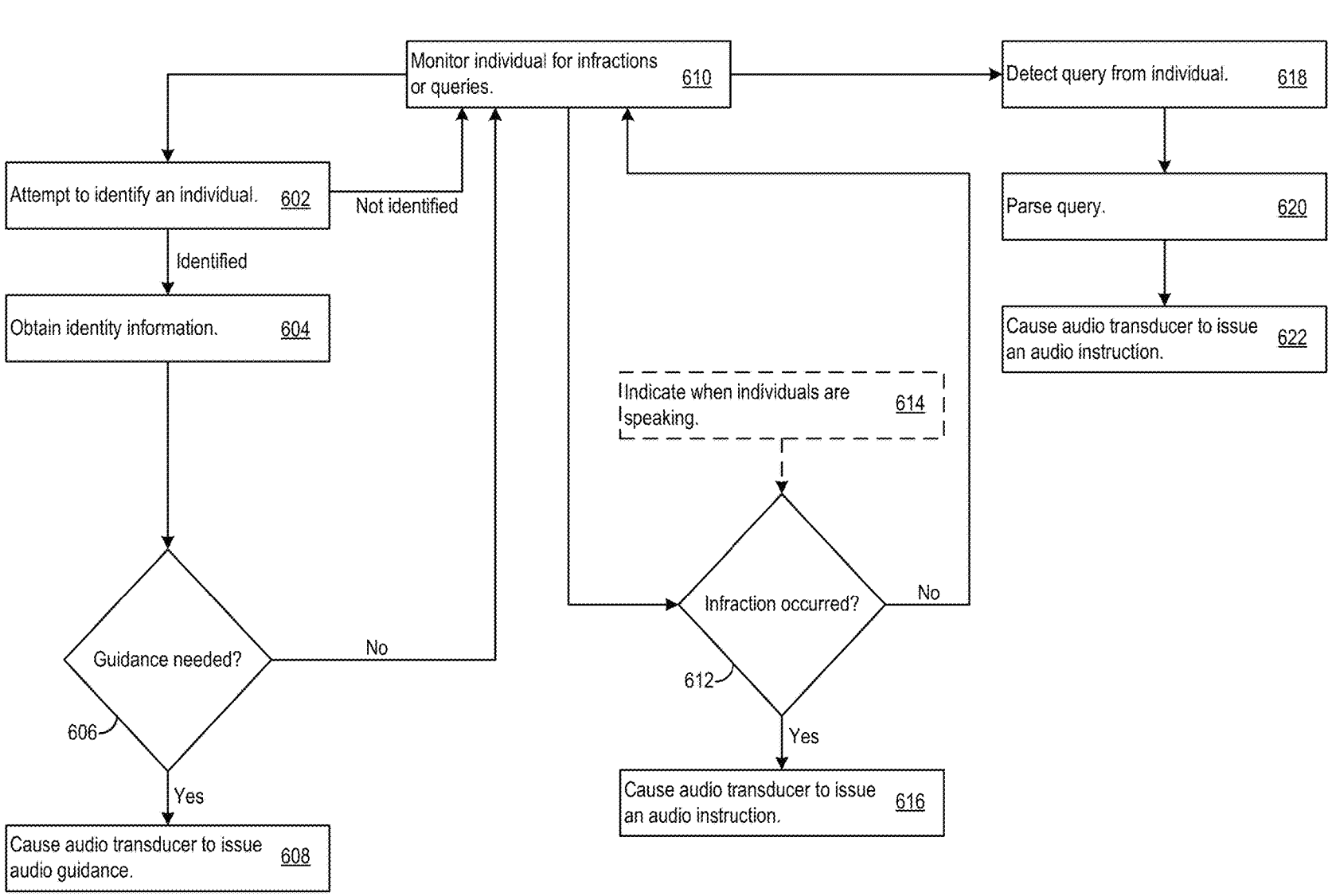
FIG. 6 shows example regulation logic.

FIG. 6 shows example regulation logic 148. The regulation logic 148 may attempt to identify an individual (e.g., such as an operator, a meeting participant, a passerby, or other individual) within a We-space (602). If the individual is identified by the DAS 100, the regulation logic 148 may access an audio profile for and/or personal information for the individual (604). Based on the audio profile and personal information, the regulation logic 148 may determine whether audio guidance may be provided to the individual (606). For example, the regulation logic 148 may determine whether the individual is in the correct location according to calendar application entries. In another example, the regulation logic 148 may provide guidance as to whether an individual as arrived at a correct conference room, as discussed above. If the regulation logic 148 determines guidance is appropriate, the regulation logic 148 may issue audio guidance to the individual via an audio transducer (608).

If the individual cannot be identified or no guidance is appropriate, the regulation logic 148 may monitor the individual for infractions or queries (610). To monitor for infractions or queries, the regulation logic 148 may monitor position information from position tracking logic 146 and captured audio from audio input sources (e.g., microphones).

Based on the position information of captured audio, the regulation logic may determine whether an infraction has occurred (612). For example, an infraction may occur when the individual speaks too loudly (e.g., exceeds a voice volume threshold) within a designated space. Additionally or alternatively, infractions may be determined to have occurred in response to polling from nearby operators. For example, the regulation logic 148 may cause the DAS 100 to indicate to nearby operators (e.g., on console UIs) when various individuals are speaking (614). If the operator is disturbed by the speech the operator may vote in favor of instructing the individual to reduce their voice volume. If a threshold number (e.g., a majority of affected operators, a pre-defined number of operator, or other threshold) of operators votes in favor of instruction, the regulation logic 148 cause an audio transducer to issue an instruction to the individual (616).

Infractions may also occur in response to position information. For example, if an individual is moving too quickly through a hallway or entering a restricted area without authorization, the regulation logic may register an infraction. Accordingly, the regulation logic 148 may cause an audio transducer to issue an instruction to the individual (616). If no infraction occurred, the regulation logic 148 may return to monitoring (610).

The regulation logic 148 may detect a query from the individual (618). For example, the individual may direct a question to an audio input source of the DAS 100. Additionally or alternatively, the regulation logic 148 may detect an incoming query in response to the individual executing a pre-defined gesture detected by the position tracking logic 146. Further, the regulation logic 148 may determine a query has been made because the individual addresses the query to a specific name assigned to the DAS 100. For example the individual may say, "Das, where is the restroom?" where "Das" is the assigned name of the DAS 100. The regulation logic 148 may parse the query (620) to determine a response. Based on the determined response, the regulation logic 148 may cause an audio transducer to issue guidance or instructions (622).

Audio Customization

The DAS 100 may perform customization of audio streams underlying the audio output of the transducers in I-spaces or We-spaces. In an example scenario, the audio control logic 144 of an DAS 100 controlling audio output within an I-space may use an audio profile of an operator to select filters for removing undesirable sounds (e.g., infrasound, mechanical hums, or other sounds), injecting preferred noise masking (e.g., white/pink/brown noise, other noise colors, natural sounds (tweeting birds, ocean waves), or other noise masking), or other audio manipulation based on personalized audio parameters specified in the audio profile. Similarly, in another scenario, a DAS 100 controlling audio output in a We-space may use an audio profile for an operator to select filters for increasing speech comprehensibility or to determine to perform a live machine-translation of the speech of another operator. Within a We-space, audio control logic 144 may also control (based on operator input) which operators within the We-space form into sub-groups (e.g., for side conversations during teleconferences).

The audio control logic 144 serves as a processing layer between incoming audio streams from audio sources and audio output destined for the ears of the operator. Accordingly, the audio control logic 144 may be used to control the quality and content of audio output sent the operator via the audio transducers.

The audio control logic 144 may use audio profiles and personal information for the operator to guide various customizations of audio streams. For example, the audio profile may specify customized audio masking, tuning or filtration for the operator. Based on these preferences, the audio control logic 144 may adjust volume levels, left-right balance, frequency, or provide other custom filtration. For example, the audio control logic 144 may tune the audio output using emotional profile filters. In some cases, humans respond positively to slightly sharper tones, which may be described as "brighter." For example in music, middle C has migrated several Hz upward since the Baroque period. Accordingly, the audio control logic 144 may frequency upshift sounds (e.g., by a few parts per hundred) to provide a brighter overall feel.

The volume and balance levels may be further calibrated for operator position to provide a consistent operator experience regardless of position shifting (e.g., position shifting short of that signifying disengagement with audio output). As discussed above, the audio preferences may be content specific (e.g., different profiles for different types of audio—music, speech, or other audio types).

The audio profile may also specify content preferences, such as coaching audio input, live translation preferences or other content preferences.

The audio control logic 144 may also modulate digital content onto analog audio outputs. For example, in implementations using inaudible sound frequencies (such as ultrasonics), digital data may be modulated onto audio output in a manner imperceptible to humans. The digital content may be used to include metadata on audio output. For example, the digital content may identify current speakers or other content sources. In some cases, the digital content may also be used for audio integrity and verification purposes. For example, a checksum may be modulated onto the audio output. The checksum may be compared to a recording of the audio stream to detect tampering. Additionally or alternatively, blockchain-based verification systems may be used. For example, a digitized version of the audible audio output may be stored within an immutable blockchain. The blockchain may be modulated onto the audio output containing the audible audio. For verification, the audible audio may be compared to the digitized audio content of the blockchain. Differences between the audible audio and the digitized audio may indicate tampering or corruption.

The audio control logic 144 may also generate tools (e.g., on console UIs, mobile applications, or other input interfaces) for input of audio profile preferences by operators. Express input of audio profile preferences by the operator may be supplemented or supplanted by machine learning algorithms running on the audio control logic 144.

The audio profile may also specify audio for capture. For example, an operator's audio profile may specify that the audio control logic 144 should capture (e.g., for analysis) audio related to the operator's pulse or respiration.

Further, the audio profile may include a voice recognition profile for the operator to aid the audio control logic 144 or regulation logic 148 in interpreting commands or queries. Accurate voice recognition profile paired with directed microphone recording may allow voice command recognition from a low whisper volume level. This may allow operators to issue voice commands in public areas without disturbing others nearby. Voice recognition profiles may also be used to aid in transcription operations, for example, in implementations where the DAS 100 may be used for dictation applications.

Figure 7:
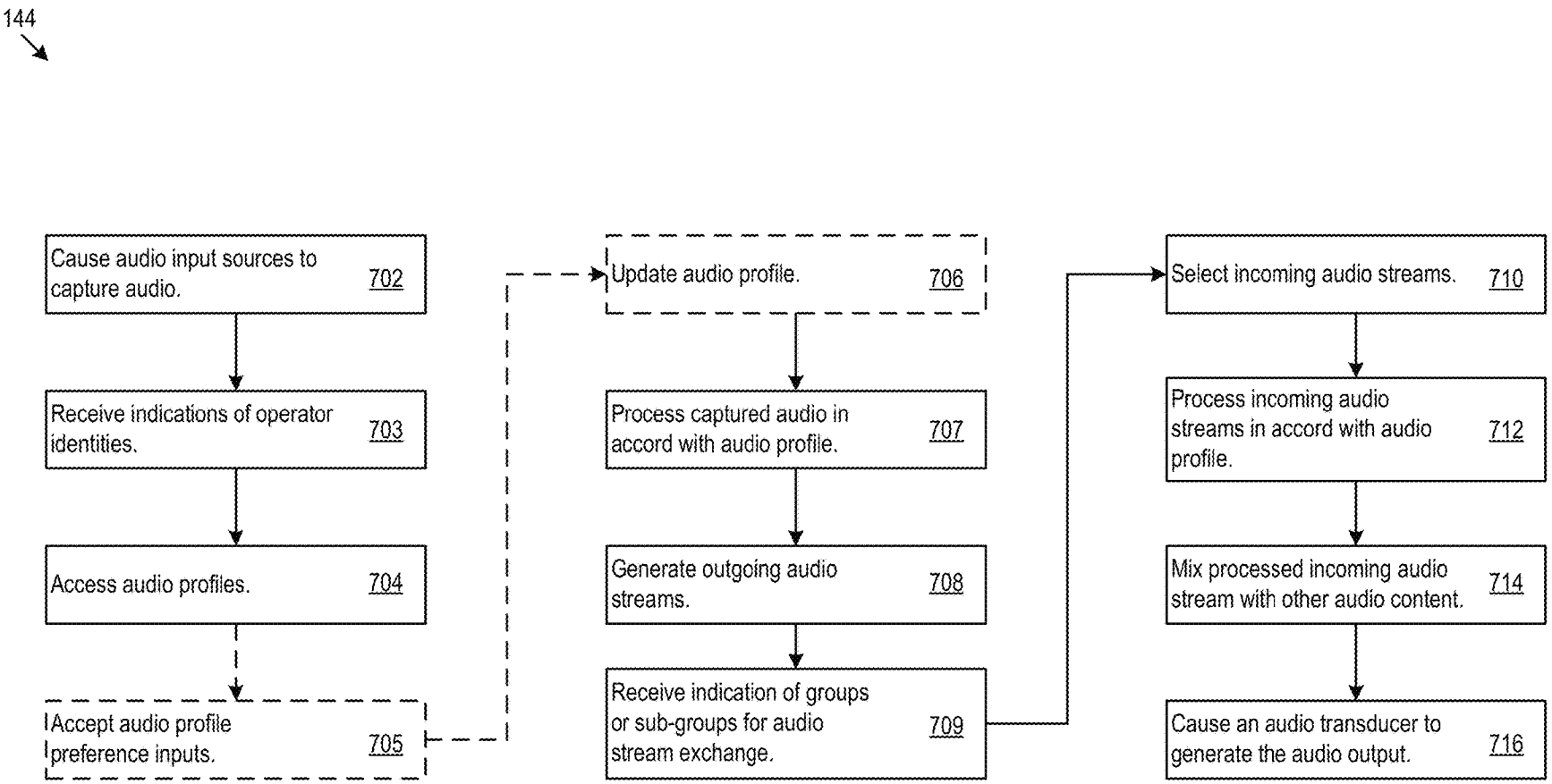
FIG. 7 shows example audio control logic.

FIG. 7 shows example audio control logic 144. The example audio control logic 144 may cause audio input sources to capture audio (702) for one or more operators. For example, the audio control logic 144 may capture audio from microphones directed at multiple operators within a We-space or an operator of an I-space. The audio control logic may receive indications of the identities of the operators (703). Responsive to the identities, the audio control logic 144 may access audio profiles for the operators (704). The audio control logic 144 may accept operator preference audio profile preference inputs (705). The audio control logic may update the audio profile based on the preference inputs (706). The audio control logic 144 may process the captured audio in accord with audio profile preferences for the operators (707). For example, the audio control logic may process the captured audio for health information or perform voice recognition to generate a transcript.

The audio control logic 144 may generate outgoing audio streams based on the captured audio (708). The audio control logic 144 may generate the outgoing audio streams in anticipation of passing audio streams based on the captured audio to other operators (e.g., within a We-space).

The audio control logic 144 may receive indications of groups or sub-groups of operators among which to exchange audio streams (709). The groups and sub-groups may be determined through operator interactions. For example, a group of operators may establish a We-space from a collection of I-spaces and/or multi-operator location spaces. Additionally or alternatively, a sub-group of operators (within a group of operators in a conference) may setup a side-conference, temporarily split off from the group. The audio from the side-conference may be exchanged among the members of the sub-group rather than being shared more broadly by the group.

In various implementations, sub-groups may be established through a two-way arbitration among inviters and invitees (e.g., using tools rendered on UI consoles or interfaces). The two-way arbitration may proceed through an invitation transfer, a second party acceptance, and a final confirmation. Alternatively or additionally, informal interactions may be used to determine sub-groups. For example, an operator may point (or otherwise gesture) towards or address by name another operator or operators to initiate a subgroup. In some cases, the position tracking logic 146 may generate a sub-group formation indicator when two or more operators shift position to face one another.

Referring again to FIG. 7, the audio control logic 144 may select incoming audio streams for generation of audio output (710). The audio control logic may process the incoming audio streams in accord with the audio profiles (712). For example, the audio control logic 144 may filter, tune, or live translate the incoming audio stream. The audio control logic 144 may mix the processed incoming audio stream with other audio content (714). For example, the audio control logic 144 may select other content such as noise masking, natural sounds, other incoming audio streams, coaching audio, text-to-speech converted text messages, or other audio content to mix with the processed incoming audio stream. Accordingly, the audio output sent to the operator may be a composite stream generated based on audio from multiple sources. The audio control logic 144 may cause an audio transducer to generate the audio output (716).

The methods, devices, processing, circuitry, and logic described herein may be implemented in many different ways and in many different combinations of hardware and software. For example, all or parts of the implementations may be circuitry that includes an instruction processor, such as a Central Processing Unit (CPU), microcontroller, or a microprocessor; or as an Application Specific Integrated Circuit (ASIC), Programmable Logic Device (PLD), or Field Programmable Gate Array (FPGA); or as circuitry that includes discrete logic or other circuit components, including analog circuit components, digital circuit components or both; or any combination thereof. The circuitry may include discrete interconnected hardware components or may be combined on a single integrated circuit die, distributed among multiple integrated circuit dies, or implemented in a Multiple Chip Module (MCM) of multiple integrated circuit dies in a common package, as examples.

Accordingly, the circuitry may store or access instructions for execution, or may implement its functionality in hardware alone. The instructions may be stored in a tangible storage medium that is other than a transitory signal, such as a flash memory, a Random Access Memory (RAM), a Read Only Memory (ROM), an Erasable Programmable Read Only Memory (EPROM); or on a magnetic or optical disc, such as a Compact Disc Read Only Memory (CDROM), Hard Disk Drive (HDD), or other magnetic or optical disk; or in or on another machine-readable medium. A product, such as a computer program product, may include a storage medium and instructions stored in or on the medium, and the instructions when executed by the circuitry in a device may cause the device to implement any of the processing described above or illustrated in the drawings.

The implementations may be distributed. For instance, the circuitry may include multiple distinct system components, such as multiple processors and memories, and may span multiple distributed processing systems. Parameters, databases, and other data structures may be separately stored and managed, may be incorporated into a single memory or database, may be logically and physically organized in many different ways, and may be implemented in many different ways. Example implementations include linked lists, program variables, hash tables, arrays, records (e.g., database records), objects, and implicit storage mechanisms. Instructions may form parts (e.g., subroutines or other code sections) of a single program, may form multiple separate programs, may be distributed across multiple memories and processors, and may be implemented in many different ways. Examples include implementations as stand-alone programs, and as part of a library, such as a shared library like a Dynamic Link Library (DLL). The library, for example, may contain shared data and one or more shared programs that include instructions that perform any of the processing described above or illustrated in the drawings, when executed by the circuitry.

Various implementations have been specifically described. However, many other implementations are also possible.

What is claimed is:

1. A method including:

determining audio profiles associated with operators at multiple pre-defined operator locations;

based on capture preferences within the audio profiles, receiving multiple captured audio streams from the multiple pre-defined operator locations;

determining to generate a mix from a subset of the captured audio streams; and causing playback of the mix at a destination, the subset excludes at least a selected captured audio stream of the multiple captured audio streams, where:

the selected captured audio stream is selected for exclusion based on a destination by determining an identity of an operator at the destination via determining that the operator at the destination is not included in a teleconference including the selected captured audio stream.

2. The method of claim 1, where the pre-defined operator locations include the destination.

3. The method of claim 1, where the subset is selected based on one or more corresponding destinations for the subset.

4. The method of claim 1, where the subset is selected based on one or more invitations sent to identities associated with corresponding operators for the subset.

5. The method of claim 1, where the capture preferences designate capture via a directed transducer array for at one of the multiple pre-defined operator locations.

6. The method of claim 1, where the destination includes a multiple-operator location.

7. A method including:

detecting an occupancy at a selected pre-defined operator location of multiple pre-defined operator locations;

determining an identity associated with the occupancy;

based on the identity, determining an audio profile associated with the identity; and responsive to the identity, causing playback of a mix of captured audio from a subset of the multiple pre-defined operator locations, the playback executed in accord with preferences from the audio profile.

8. The method of claim 7, where detecting the occupancy includes operating position tracking hardware disposed at the selected pre-defined operator location.

9. The method of claim 8, where the position tracking hardware includes ranging sensor circuitry, proximity sensor circuitry, or both.

10. The method of claim 7, where casing playback of the mix responsive to the identity includes determining that an invitation to a teleconference was provided to the identity.

11. The method of claim 7, where the subset is selected based on one or more invitations sent to identities associated with corresponding operators for the subset.

12. The method of claim 7, where the preferences designate capture via a directed transducer array for at the selected pre-defined operator location.

13. The method of claim 7, where the selected pre-defined operator location includes a multiple-operator location.

14. The method of claim 7, where determining an identity associated with the occupancy includes receiving data from proximity sensor circuitry, biometric identification circuitry, or both.

15. A system including:

network interface circuitry configured to establish communication links with audio processing circuitry at multiple pre-defined operator locations; and control circuitry configured to:

determine audio profiles associated with operators at the multiple pre-defined operator locations;

based on capture preferences within the audio profiles, receive multiple captured audio streams from the multiple pre-defined operator locations via the network interface circuitry;

determine to generate a mix from a subset of the captured audio streams; and cause, via the network interface circuitry, playback of the mix at a destination, the subset excludes at least a selected captured audio stream of the multiple captured audio streams, where:

the selected captured audio stream is selected for exclusion based on a destination by determining an identity of an operator at the destination via determining that the operator at the destination is not included in a teleconference including the selected captured audio stream.

16. The system of claim 15, where the pre-defined operator locations include the destination.

17. The system of claim 15, where the control circuity is configured to select the subset is based on one or more corresponding destinations for the subset.

18. The system of claim 15, where the subset is selected based on one or more invitations sent to identities associated with corresponding operators for the subset.

19. The system of claim 15, where the capture preferences designate capture via a directed transducer array for at one of the multiple pre-defined operator locations.

20. The system of claim 15, where the destination includes a multiple-operator location.

* * * * *